US008794826B2

(12) United States Patent
Tracy

(10) Patent No.: US 8,794,826 B2
(45) Date of Patent: Aug. 5, 2014

(54) SECURE, PROTECTIVE COVER FOR USE WITH HOT APPLIANCES

(76) Inventor: Judith Tracy, Summit, NJ (US)

( * ) Notice: Subject to any disclaimer, the term of this patent is extended or adjusted under 35 U.S.C. 154(b) by 568 days.

(21) Appl. No.: 13/017,855

(22) Filed: Jan. 31, 2011

(65) Prior Publication Data

US 2012/0193002 A1 Aug. 2, 2012

(51) Int. Cl.
*G01K 1/08* (2006.01)
*G01K 1/02* (2006.01)

(52) U.S. Cl.
USPC ..... 374/141; 116/216

(58) Field of Classification Search
None
See application file for complete search history.

(56) References Cited

U.S. PATENT DOCUMENTS 5,577,607 A * 11/1996 Drake et al. ..... 206/349
5,816,305 A * 10/1998 May ..... 150/165
6,250,593 B1 * 6/2001 Palu ..... 248/117.2
6,497,061 B1 12/2002 Aleksic et al.
6,499,519 B1 12/2002 Brown
6,808,066 B2 * 10/2004 Bean ..... 206/349
7,637,040 B2 * 12/2009 Wu et al. ..... 38/89
2001/0019050 A1 * 9/2001 Rock et al. ..... 219/545
2003/0087566 A1 * 5/2003 Carlyle et al. ..... 442/59
2003/0181115 A1 * 9/2003 Nagasuna et al. ..... 442/149
2004/0004196 A1 * 1/2004 DeMeo et al. ..... 250/516.1
2006/0278631 A1 * 12/2006 Lee et al. ..... 219/529
2008/0075850 A1 * 3/2008 Rock ..... 427/176
2008/0083740 A1 4/2008 Kaiserman et al.
2009/0173648 A1 * 7/2009 Geneva ..... 206/320
2010/0071235 A1 * 3/2010 Pan et al. ..... 38/141

OTHER PUBLICATIONS

Newtex Industries, "High Temperature Fabrics and Sewing Threads", Feb. 21, 2009.*

* cited by examiner

*Primary Examiner* — Lisa Caputo
*Assistant Examiner* — Nasir U Ahmed
(74) *Attorney, Agent, or Firm* — Ward & Zinna, LLC

(57) ABSTRACT

A secure cover for a hot appliance made with heat resistant material having an insulation layer between heat resistant layers that can be stitched with heat resistant thread. The cover prevents users from burning themselves and can be in a shape that covers the hot part of the appliance. The cover has an encasement enclosing a band. The encasement runs along the cover's perimeter and secures the cover on the appliance. The cover may include flares that are used to attach the secure cover to the hot appliance without having the user's fingers approach too close to the hot metal of the appliance. The cover transmits heat, allowing the individual to be aware of the fact that the appliance is hot. The cover may include temperature sensitive fabric, a light indicator or other visual display with a written indication that the appliance is hot.

16 Claims, 9 Drawing Sheets

SECURE, PROTECTIVE COVER FOR USE WITH HOT APPLIANCES

FIELD OF THE INVENTION

The invention relates to protective covers for hot appliances or devices. More specifically, the present invention is for a cover designed for a hot appliance constructed with heat resistant material having an interior lining of insulation. Preferably, the cover is placed on a hot appliance to prevent users or passersby from coming in contact with conductive and convective heat from the appliance and from coming in direct contact with a hot appliance. In this manner, the cover protects individuals from the hot part(s) of the appliance and any steam that may be emanating from the appliance. Optionally, the cover may include temperature sensitive fabric on its exterior that changes color based upon the device's temperature. The use of this fabric serves as an additional safety feature of the cover and visually alerts individuals of the temperature of the appliance and the cover.

BACKGROUND OF THE INVENTION

Household appliances traditionally do not have heat protective covers. A cover may be available for covering an appliance that is decorative in nature, or is applied to prevent the collection of dust on an appliance. However, these types of decorative covers are not for use when the appliance is hot. The decorative covers are only for use after the appliance has completely cooled and is not longer emanating heat. These types of covers are commonly made with materials such as cotton or polyester. The types of materials used in prior art covers do not have any heat protection or heat resistant qualities nor do they offer any protection from exposure to steam. These types of materials are not resistant to heat and are flammable at high temperatures. These covers cannot be used on an appliance that is still heated from use. They cannot be used on an appliance that produces steam. This is true for toaster covers, hot plate covers, etc.

Currently, there does not exist on the market protective covers for irons and similar appliances or devices where the cover may be used and applied to the appliance when it is at an elevated temperature. Nor does there exist on the market protective covers for irons and similar appliances or devices where the cover may be used and applied to the appliance when it is releasing steam. Certain appliances or devices may be left in the open, increasing the chance of exposure to the heated appliance, which can cause burns on human skin. The current practice in homes or industry (i.e., restaurant kitchens) is to verbally warn people in the immediate vicinity that the appliance is still hot or to otherwise caution individuals that an appliance is hot and a danger. Of course, more common to those situations is to assume individuals will notice that the appliance has been recently used because he/she was in the room during the use of the appliance. The individual may assume the appliance has been recently used if he/she feels heat emanating from the appliance. However, there is always a possibility that someone is in a rush and in his/her haste, bumps into or otherwise comes in contact with the hot appliance. In these situations, the individual has a greater risk of burning himself/herself on the hot appliance. Also, in the event the individual is merely working near or close to the hot appliance, the individual could inadvertently bump the hot appliance, thereby burning his/her skin. Alternatively, the cord of the appliance could become entangled with someone or something, and be pulled from where it is stored. For example, the cord of an iron could become entangled by a child, and the iron could fall on the child and burn the child. In another situation, an iron or hot plate may fall and burn the surface on which it lies or start a fire.

In the view of the foregoing, a need exists for a cover that can be placed over a hot appliance to protect individuals from burning themselves on the appliance while it is still hot or releasing steam.

There exists a need for a cover that visually alerts individuals that an appliance is hot with, for example, the use of a temperature sensitive material that changes color on the cover's exterior, or the use of a temperature sensor connected to a light or other visual display on the protective cover's exterior.

There also exists a need for a cover that transmits some of the heat emanating from the appliance that can be sensed by an individual and which alerts the nearby individual that the appliance beneath the cover is heated or hot and minimizing dangers of being burned.

There exists a need for a cover that fits securely onto a hot appliance and that will not fall off inadvertently. In the event an appliance such as an iron or hot plate falls, the cover would remain secure to the iron or hot plate and would not become dislodged from the appliance.

There exists a need for a cover that is easily placed securely onto a hot appliance where the individual or user does not burn his/her fingers during the process of placing the protective cover on the hot appliance.

There exists a need for a cover that allows for air flow through the cover in a manner that allows cool air to reach the hot surface of the device or appliance so that it can cool down. The transmission of the heat serves the function of enabling the hot appliance to cool, prevents condensation from forming on the appliance, and also acts to alert an individual that the appliance is hot because some of the heat is transferred to the exterior surface of the cover and can be detected by an individual.

The present invention overcomes a number of limitations of current devices currently known and/or available. Other objects, features, and characteristics of the invention, as well as methods of operation and functions of the related elements of the structure, and the combination of parts and economies of manufacture, will become more apparent upon consideration of the following detailed description with reference to the accompanying drawings, all of which form part of this specification.

BRIEF SUMMARY OF THE INVENTION

The present invention embodies a secure protective cover for a hot device or appliance. The cover is preferably made with heat resistant material and an interior lining of insulation placed between layers of the heat resistant material. The cover is placed on the hot part of an appliance to prevent users or passersby from coming in direct contact with a hot appliance, thereby protecting them from the hot part(s) of the appliance. The heat resistant material is used as the inner most layer of the cover that comes in direct contact with the hot appliance. The heat resistant material is also on the outermost layer of the cover. Between the layers of the heat resistant materials is an interior space for an insulating layer. The insulating layer functions to prevent all of the heat of the hot appliance from passing through to the outer surface of the cover. However, the insulating layer allows some heat to pass through the cover so that the exterior of the cover may become warm at most (not hot). In this way, the cover allows the hot appliance to cool because there exists a stream of air flow to allow heat to escape gradually. This air flow, conversely, allows cool air to reach the hot interior—the hot surface of the appliance. The cool air thereby assists in the cooling of the hot appliance gradually. The cover, which is constructed with heat resistant material, can be designed from one piece of fabric. In this embodiment, the heat resistant material may fold over so as to create an interior space in which to insert heat resistant insulation. In another embodiment of the invention, the cover may be formed with separate pieces of heat resistant fabric that are sewn together.

The cover is made with heat resistant fabric, insulation, and has stitching joining the different layers of material using heat resistant thread, however, in other non-limiting embodiments, glue, staples, or other similar types of fasteners may be utilized for connecting the different layers of material. The heat resistant material may be used as an inner layer and an outer layer. An insulating material or materials may be placed between the inner layer and outer layer, forming a third or middle layer. This layer is also referred to at times as the interior lining. These layers typically would be stitched together using heat resistant thread. Of course, there can be any number of layers utilized with the invention—both heat resistant layers and insulating layers. The layers, their construction and number will vary on manufacturing specifications, the size of the appliance, and other factors that need to be considered for constructing the protective cover for a hot appliance.

A perimeter encasement for securing the cover to an appliance is utilized with the present invention. This encasement is formed with the heat resistant fabric for containing an elastic material (hereinafter referred to as "elastic"), such as an elastic band although, in other non-limiting examples, a drawstring, a coiled spring, or other similar types of materials may be utilized. The encasement is constructed from heat resistant material and extends the length of the perimeter of the cover. The encasement may be formed by one piece of fabric folded over and stitched down one side parallel to the fold. The stitching may be completed with, for example, heat resistant thread. The encasement may also be constructed using two pieces of heat resistant fabric that are the same width and length, having a longer length and narrow width. The length should be constructed so as to extend at a minimum the perimeter of the cover. The width, at a minimum, should be a size sufficient to hold the elastic of any suitable width. The width may depend upon the size of the elastic, both in thickness and the width of the elastic itself. The width of the encasement would be formed to have additional space on either side of the elastic. In this manner, the elastic rests inside the encasement without touching the folded or the stitched edges. Additionally, the elastic extends throughout the encasement and would typically extend to match the perimeter of the cover. Various modifications to the encasement and to the elastic may be made to accommodate a variety of appliances, their size, type, and structure. The encasement with the elastic is attached to the cover. Typically, the encasement is attached to the perimeter of the cover by stitching or sewing one side of the length of the encasement to the perimeter of the cover.

The function of the encasement with the elastic is to secure the cover on the appliance itself, but preferably to secure the cover on the hot part of the appliance. For example, the sole plate of an iron is the hot part of the iron when the appliance is turned on. The cover can be designed to fit snugly and securely on the sole plate only. Variations in the design and structure of the cover may be made without affecting the overall purpose of the invention. For example, some variations may be implemented in the structure and design of the cover to create a more decorative cover.

The cover may be created in a shape that is suitable to cover the hot part of the appliance. For example, an iron cover is in the shape of the sole plate that becomes hot. The cover will include, in one example, an elastic band placed at perimeter of the heat resistant fabric. The elastic band would be completely encased by the heat resistant fabric and sewn into a fixed position at the perimeter of the cover by stitching using heat resistant thread. The elastic band placed at the perimeter of the cover functions to expand over the circumference of the sole plate and retract causing the cover to be securely held in position over the sole plate. This method of affixing eliminates the need for additional ties, snaps or other methods for affixing the cover to the heated appliance.

The cover may have additional pieces of fabric extending beyond the elastic perimeter of the secure cover. These additional pieces of fabric, sometimes referred to as flares herein, provide the user with a tool by which to attach the secure cover to the hot appliance without having the user's fingers or hands approach too close to the hot metal of the appliance. The flare may be a piece of the heat resistant material that extends along the outer perimeter of the encasement. The flare may be two or more pieces of heat resistant material attached to the outer perimeter of the encasement at different locations. The user may use the flares to stretch the cover and the encasement with elastic over the hot appliance. The flares may be affixed to the outer length of the encasement in a manner that extends away from the interior of the cover. Thus, when the user attaches the cover to the hot appliance, his/her hands are able to hold the cover and place the cover over the hot appliance while maintaining a safe distance from the hot part of the appliance to prevent accidental burning of the skin while applying the cover. Additionally, the flares may have a more complex structure that further protects the user from the hot part of the appliance. The flares may have an additional form that creates a pocket for the user's hand or finger(s). Where the flare forms a pocket, the user inserts his or her hand or fingers fully into the pocket. The user's hand or fingers are further protected by the use of the pocket—flare design.

The interior lining of the cover provides an insulating feature of the cover to protect the individual from the direct heat emanating from the hot appliance. The lining would also be able to minimize the heat transmitted through the cover. The heat resistant fabric also transmits some heat through the material. Accordingly, the cover with its various layers is able to minimize the heat transmitted through the layers—insulation layer, protective heat-resistant fabric layer—thereby allowing the individual to become and remain aware of the fact that the appliance is hot. The insulation may be of a permeable nature such as a sponge material, silicon or similar insulating materials. The insulation may also have openings in it to allow air and heat to pass through the insulation layer. The insulation layer may be designed in a manner that does not fill the interior completely thereby creating air pockets. For example, the insulation may be formed with a third layer of heat resistant fabric. In one embodiment, the insulation could be a series of smaller pieces of insulation that are inserted into or attached to the third layer of material that rests in the interior section of the cover. The insulation layer could be formed in a manner so as not to fully extend the full surface area of the cover itself. Thus, the insulation layer would cover the majority of the surface area of the cover to protect the user from the direct heat of the hot appliance.

The cover may, optionally, include a piece of color changing material on its exterior surface that functions as a visual signal to an individual of the temperature of the appliance. The color changing material changes color with temperature. Thus, the use of the color changing material on the exterior of the cover serves to visually alert the user and/or passersby that the appliance under the cover is at a certain temperature (i.e., hot or cold). The use of the color changing material could be used as a fourth layer that forms the exterior of the cover. The color changing material may be applied to the exterior layer (i.e., the heat resistant fabric) in a manner that would optimally or efficiently detect any heat or temperature change in the appliance. The color changing material may attach to the exterior as one stripe across the exterior surface of the cover using the heat resistant thread to sew the material to the exterior layer. The color changing material could be cut into a design or shape that is decorative. The decorative shape may be sewn onto the exterior layer. The color changing material may be optionally added to the cover in order for the cover to have a visual change in appearance when the temperature of the cover changes due to the temperature of the appliance on which the cover is placed. The use of this material adds another safety feature to the cover.

The cover allows air flow through the fabric. In this manner, the hot appliance is able to cool gradually because the cover allows heat to permeate through it and escape while simultaneously allowing cooler air through the material to cool the hot appliance. The cover may be perforated to (a) allow heat to escape and (b) to allow cool air to reach the hot metal of the appliance, and (c) to provide for air flow wherein the hot metal decreases in temperature gradually while remaining covered to prevent direct contact of skin with the hot metal thereby eliminating and preventing an individual from burning himself or herself on the hot metal. The insulation placed in the interior of the heat resistant material may have openings in the insulation to allow air to permeate so that the hot appliance may cool and no condensation builds up within the cover. The secure protective cover can be stitched together with heat resistant thread. However, other methods known in the arts for attaching the materials may be used. The secure cover will have a shape similar to the shape of the hot portion of the appliance. In this way, the secure cover fits closely or snugly onto a hot appliance.

BRIEF DESCRIPTION OF THE DRAWINGS

A further understanding of the invention can be obtained by reference to a preferred embodiment set forth in the illustrations of the accompanying drawings. Although the illustrated embodiment is merely exemplary of devices for carrying out the invention, both the organization and apparatus of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the invention, reference is now made to the following drawings in which.

DETAILED DESCRIPTION OF THE INVENTION

As required, a detailed illustrative embodiment of the invention is disclosed herein. The present invention may be understood more readily by reference to the following detailed description of preferred embodiments of the invention. However, techniques, systems, and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present invention. It must be noted that, as used in the specification and the appended claims, the singular forms "a", "an", and "the" include plural referents unless the context clearly indicates otherwise. The following presents a detailed description of the preferred embodiment of the invention (in addition to some alternative embodiments).

Figure 1:
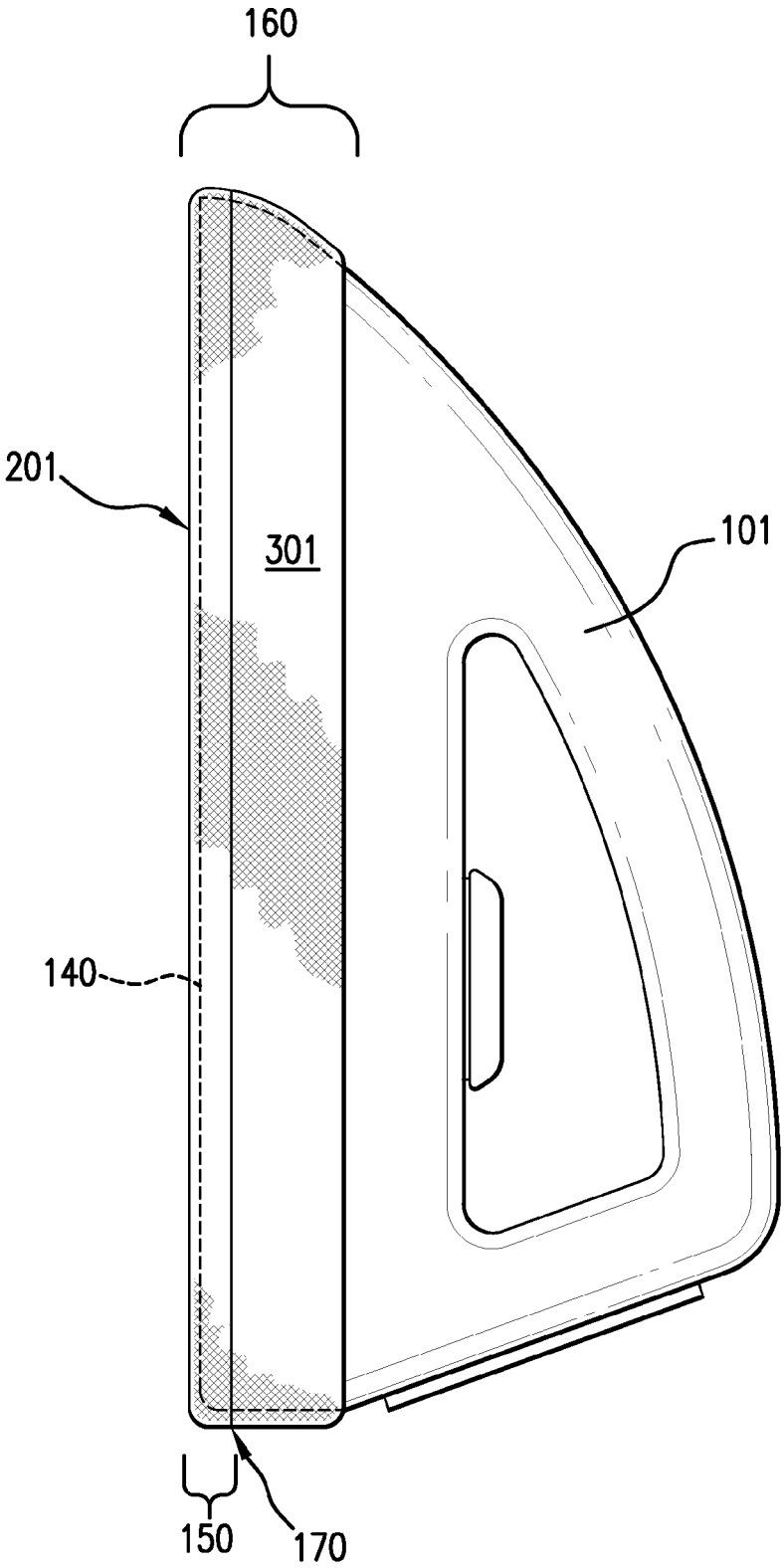
FIG. 1 is a side view of the preferred embodiment of the invention depicted in the form of a secure protective cover for an iron, shown with the secure cover of the invention placed on the iron's sole plate.

Referring first to FIG. 1, depicted is a side view of iron 101 with a secure cover 160 placed on sole plate 140 according to a preferred embodiment of the invention. As shown, iron 101 includes cover 160 attached to and covering sole plate 140. Cover 160 is preferably constructed with heat resistant fabric layer assembly 201 containing a middle layer of insulation between at least two layers of heat resistant fabric. These layers of heat resistant fabric and insulation form the portion of the cover 160 that covers the sole plate 140 of iron 101. Also shown in FIG. 1, encasement 301 attaches to fabric layer assembly 201 along the perimeter 170. Also shown in FIG. 1, encasement 301 preferably contains elastic material such as, for example, an elastic band, a drawstring, a coiled spring, or other similar types of selectively expandable material that may shrink back and provide for the cover 160 to be securely attached to, in one example, to the sole plate 140 of the iron 101 (as shown), or in other non-limiting examples, in other shapes to attach cover 160 to any other appliance or device.

Figure 2:
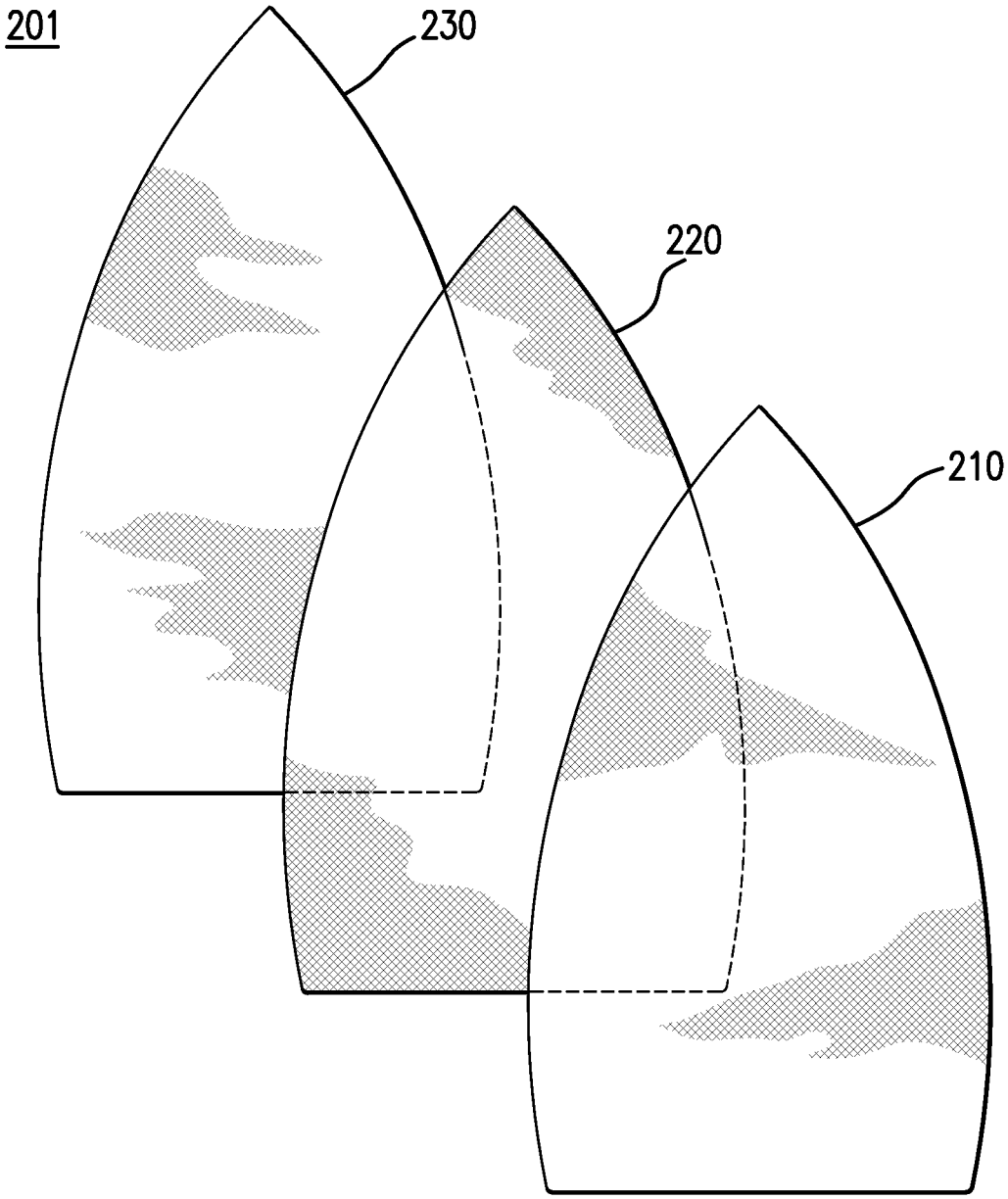
FIG. 2 is a bottom view of the preferred embodiment of the secure protective cover, shown with each of its layers depicted separately.

Turning to FIG. 2, depicted is a bottom view of the preferred embodiment of secure protective cover 160, shown with each of its layers depicted separately at 210, 220, and 230. The bottom surface of the cover 160 is preferably formed from a series of layers of fabric 210 and 230 with an insulating layer 220 between them. These layers of fabric 210, 230, and the layer of insulation 220, may all be the same size, or in other examples, the layer of insulation 220 may be of a different size or shape from the layers of fabric and may vary in density and thickness. The layers 210, 230 and 220 are preferably stitched together using heat resistant thread. It should be appreciated that the any or all layers of fabric 210, 230, and insulation 220 may selectively include perforations or holes to increase the flow of air through each of these layers 210, 220, and 230.

The preferred materials for the secure protective cover consist of heat resistant fabric made by any number of manufacturers, and may be made with materials that can withstand scorching at temperatures around 400 degree Fahrenheit, such as, for example, Tencate freestyle, DuPont fabrics, Nomex blend materials, or other similar types of materials. Nomex and Kevlar are two types of aramids, which are a class of heat-resistant synthetic fibers. Such fibers are generally used in aerospace and military applications, for ballistic rated body armor fabric, in protective garments, bicycle tires, and as electrical insulators. Aramids are fibers, so they can be made into various forms including threads and fabrics, depending on the desired application. These heat resistant fabrics can be stitched with Kevlar thread.

Other heat-resistant materials, which are not created with aramids, include products from ADL Insulflex Inc. and Kuraray Co., Ltd. such as the pyroblanket, silicaflex blankets, and Vectran™ products that are heat resistant. Both use other materials such as ceramic, stainless steel thread and/or glass fiber to create heat resistant cloth products. A combination of materials may be used in order to reach a preferred fabric with heat, fire and flame resistant qualities that are optimal for special situations or circumstances.

The benefit of using these types of fabrics is that they act as a protective layer to an individual that may come in contact with the fabric when it is covering a hot appliance, thereby preventing the individual from coming into direct contact with the hot appliance and preventing any potential for burns or damage to the individual. These types of fabrics also allow some heat to pass through the fabric. In this manner, the individual becomes aware that the appliance underneath and/or covered by the fabric is hot and dangerous to direct contact.

The secure cover of the present invention includes an insulation layer 220, which may include silicone, rubber or other synthetic insulating materials. Foams are another class of insulating materials that may also be used with the present invention. Other non-limiting examples of materials that may be used as insulation include cork, butyl-rubber, neoprene, polyethylene, polyester polyether, or other similar materials.

The secure protective cover 160 of the present invention may also comprise thread that is fire resistant, although this is an optional embodiment of the present invention. Because the main concern is for the materials that come in direct contact with the heated metal of the appliance to have the heat resistant and/or fire resistant qualities, the thread that is used to construct the present invention may be heat resistant. However, this is not required in order for the present invention to function appropriately and serve its purpose. In other non-limiting embodiments, staples, tacks, or similar types of attachment materials may be utilized.

Figure 3:
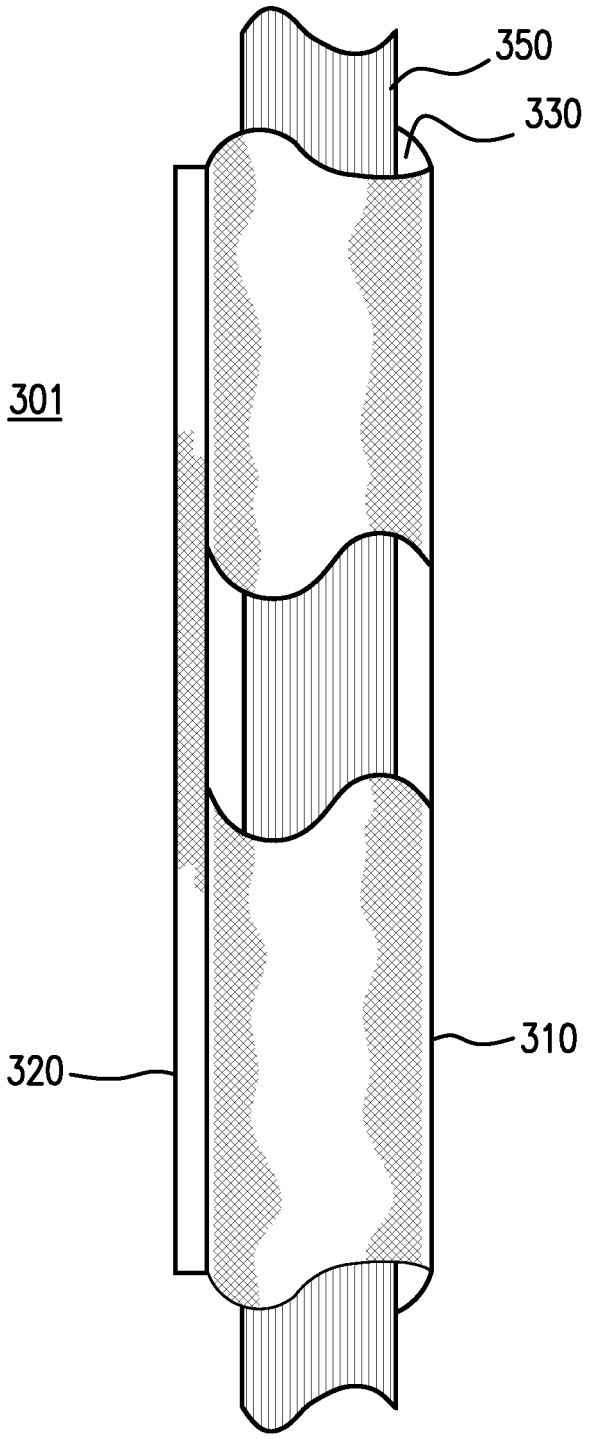
FIG. 3 is a partial perspective view of an encasement for use with the preferred embodiment of the secure protective cover, shown with an elastic cord that forms the perimeter of the secure protective cover.

Next, FIG. 3 shows a partial perspective view of an encasement 301 for use with the preferred embodiment of the secure protective cover. In one non-limiting example, elastic cord 350 is shown within encasement 301, however, other materials such as drawstring, coiled spring, or similar may be utilized without departing from the scope of the invention. Encasement 301 with elastic cord 350 extends the perimeter of the secure protective cover 160. Encasement 301 with elastic cord 350 attaches to the perimeter of the bottom of the fabric layer assembly 201. Encasement 301 may be constructed from one piece of heat resistant material that is folded or rolled lengthwise, with its ends sewn together to form border 320. Alternatively, encasement 301 may be constructed from two pieces of heat resistant fabric that are sewn together along the length of the encasement 301. In this manner, a hollow interior 330 of the encasement is formed. Elastic cord or material 350 is inserted into the hollow interior 330 and preferably runs throughout the length of encasement 301.

Optionally, encasement 301 may be sewn or otherwise attached to the fabric layer assembly 201 of the cover along its perimeter, as shown in FIG. 1 at 170. Alternative means and methods of attaching encasement 301 to fabric layer assembly 201 of cover 160 may also be used as may be known in the art and/or available. The completed cover 160 may now be placed on iron 101 or some other device or appliance for which the cover is designed to fit. As depicted, once cover 160 is applied, fabric layer assembly 201 of cover 160 covers sole plate 140 of iron 101 while encasement 301 fits securely around the front tip, shell and heel of the iron 101 such that cover 160 is secured upon iron 101. Accordingly, cover 160 is securely in place while iron 101 is not in use, as depicted in FIG. 1, such that it will not fall off and can only be removed by applying force to encasement 301 and extending it from the base of iron 101.

Figure 4:
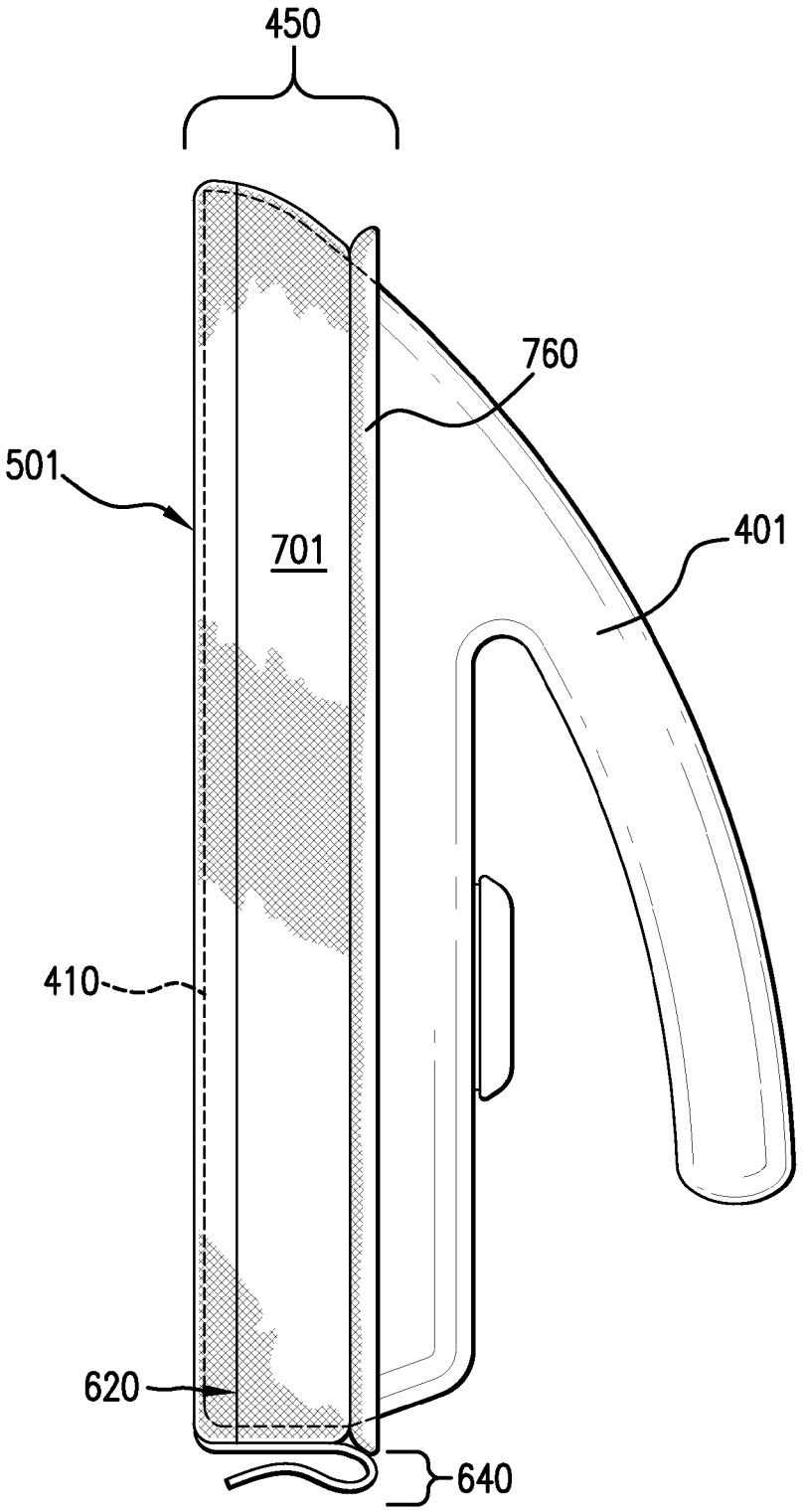
FIG. 4 is a side view of an alternative embodiment of the invention depicted in the form of a secure protective cover for an iron, shown with the secure protective cover placed on the iron and with the cover having optional hand grips.

FIG. 4 is a side view of secure protective cover 450 attached to iron 401 according to an alternative embodiment of the invention. As shown, iron 401 includes cover 450, which is substantially similar to the cover 160 shown and described in FIGS. 1-3, and includes heat resistant fabric layers containing a middle layer of insulation between at least two layers of heat resistant fabric. These layers of heat resistant fabric and insulation form the base assembly 501 of the cover 450 that covers the sole plate 410 of the iron 401. This base assembly 501 is described in detail at FIG. 5. Encasement 701 attaches to base assembly 501 along the perimeter 620. Encasement 701 preferably contains elastic material or some other similar material that provides for the cover 450 to attach securely to, in one example, sole plate 410 of the iron 401 as shown, and may be provided in various shapes to cover any appliance or device that the cover is intended to be used.

Cover 450 includes optional hand grips 760 and/or "hook-shaped" hand grip 640. While both the hand grip 760 that is shown as a flare around the perimeter of the cover and the hand grip 640 at the base of iron 401 are shown in FIG. 4, these hand grips 760 and 640 may be added either individually or together to the cover 450 (i.e., cover 450 may have hand grip 760 but not hand grip 640, or cover 450 may have hand grip 640 but not hand grip 760). In another non-limiting embodiment, the flare 760 may be selectively shortened around the perimeter of the iron 401 to be provided at specific locations around the encasement 701 based on user or manufacturer preference.

Figure 5:
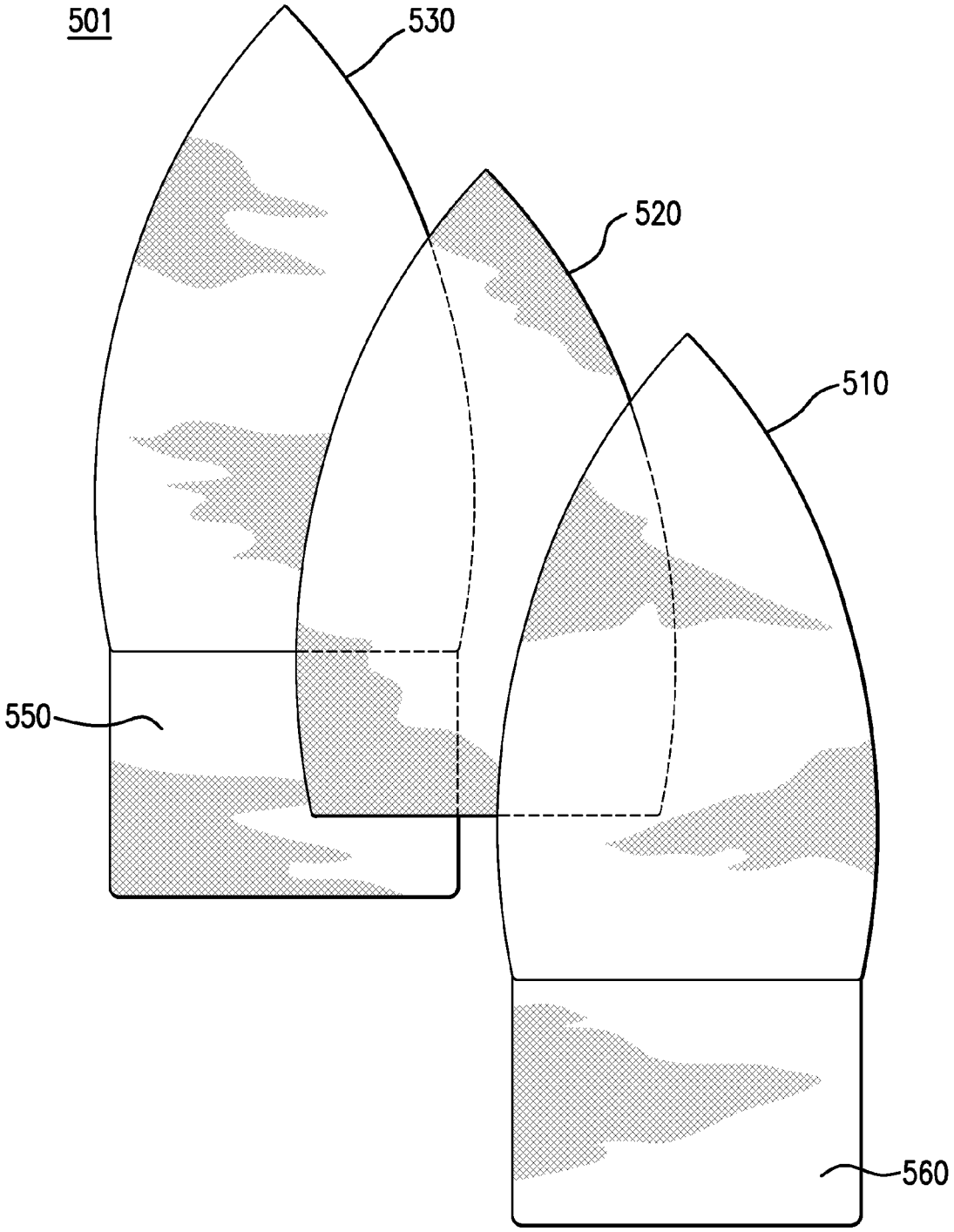
FIG. 5 is a bottom view of the secure protective cover shown in FIG. 4, shown with each of its layers depicted separately.

FIG. 5 is an exploded view of the secure protective cover 450 shown in FIG. 4, with each of its layers depicted separately at 510, 520, and 530. As shown in FIG. 5, the bottom portion of cover 450 includes layers of heat resistant fabric as a top and bottom layer shown at 530 and 510, respectively. Between the top layer 530 and the bottom layer 510 is an insulation layer 520. The top layer 530 and the bottom layer 510 may optionally have an additional rectangular piece of heat resistant material 550 and 560 attached to one end or side thereof. For iron 401 (FIG. 4), the additional rectangular pieces of material 550 and 560 are added to the flat end of the cover 450 that is matched with the bottom or heel of the iron, and may be folded over on itself to form a hand grip as shown at 640 in FIG. 6. Alternatively, these pieces are sewn together to form base 640 of cover 450 depicted in FIG. 4. In another non-limiting embodiment, perforations or holes may be provided in any or all layers 510, 520, and 530 in order to increase the flow of air through any of these layers 510, 520, and 530 in order to allow the heat from iron 401 to dissipate quicker.

Figure 6:
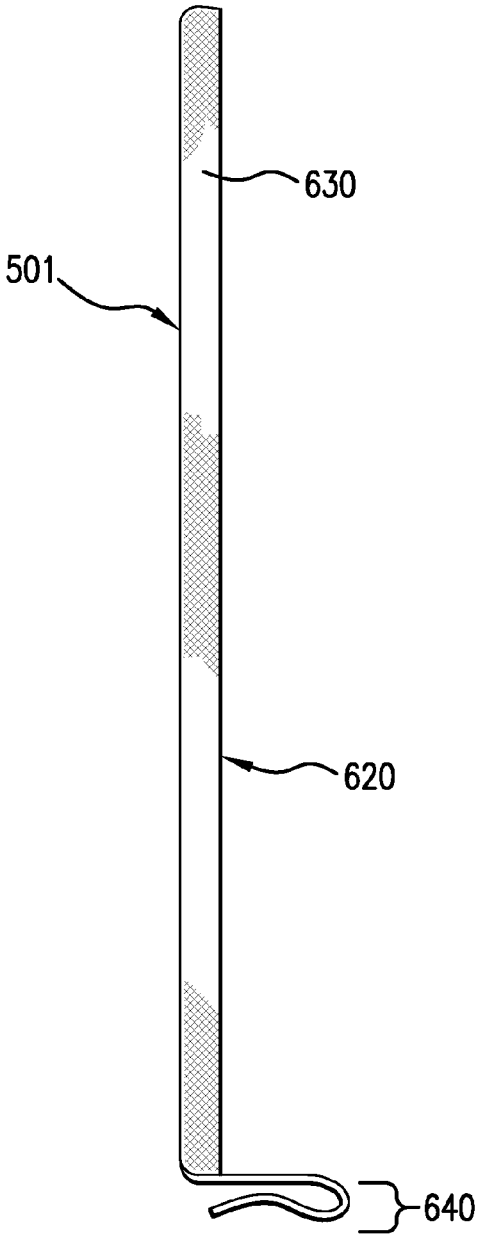
FIG. 6 is a side view of an alternative embodiment of the cover with a hand grip at one end of the cover.

FIG. 6 is a side view of the protective layers of cover 450 shown in FIG. 5. As shown, secure protective cover 450 includes handgrip attached to the broader end (shown at 640) which is formed from the additional rectangular pieces of material (i.e., shown at 550 and 560 in FIG. 5) added to layers 530 and 510. The additional rectangular pieces are an extension off the bottom of the cover 450. The additional rectangular pieces can be folded into even halves and sewn at the short sides (the width), thereby forming an enclosure for a person's fingers. This is an alternate perspective view of the bottom of the cover 450 that forms the perimeter of the secure protective cover. FIG. 6 shows a side view of enclosure 640 into which a person may insert their fingers to grab the cover 450 in order to place the cover onto a hot appliance without putting their fingers in direct contact with the hot appliance. The thickness of the base assembly 501 of the cover is indicated at 630 and includes the insulation layer between at least two layers of heat resistant material. The perimeter 620 may be attached to encasement 301 depicted in FIG. 3 or encasement 701 depicted in FIG. 7.

Figure 7:
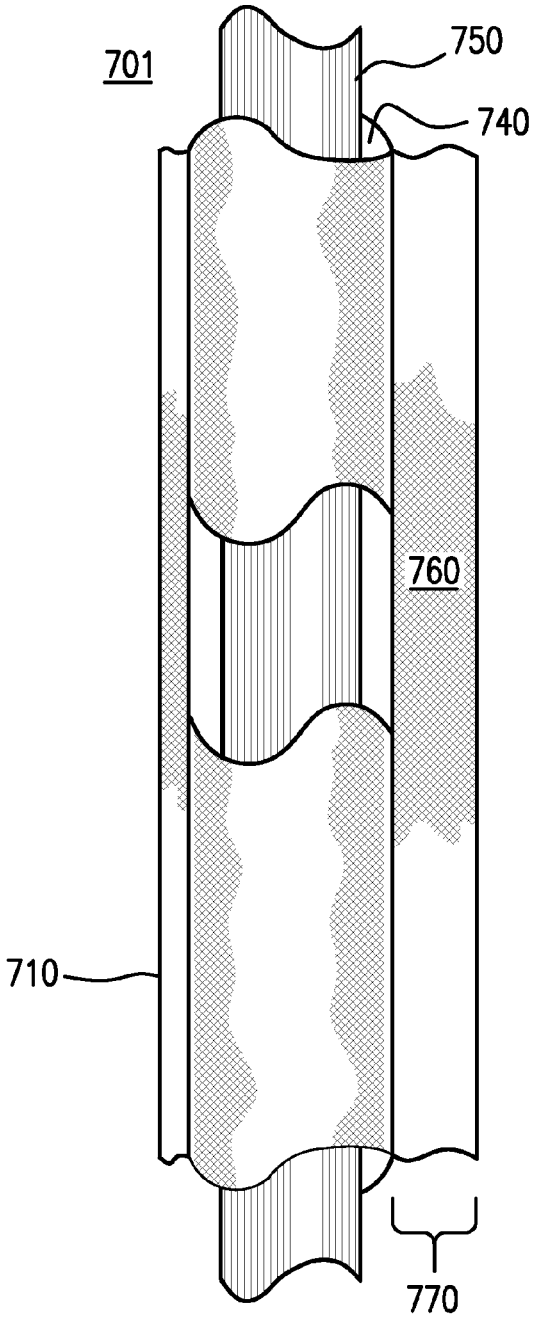
FIG. 7 is a partial perspective view of an alternative embodiment for an encasement for use with the any of the embodiments of the secure protective cover, shown with an elastic cord that forms the perimeter of the secure protective cover and further shown with a hand grip.

Turning next to FIG. 7, shown is an encasement 701 with an alternate flare 760, which contains additional material on the side opposite the length of encasement 701 that attaches to the cover's base assembly 501 (FIG. 6) according to an alternate embodiment of the invention. Elastic cord 750 is shown within encasement 701. Encasement 701 with elastic cord 750 extends the perimeter 620 (FIG. 6) of the secure protective cover 450 (FIG. 4) by allowing the cover 450 to be expanded along the perimeter of the encasement and fit over the perimeter of the sole plate of iron 401 (FIG. 4). Encasement 701 with elastic cord 750 attaches to the perimeter 620 (FIG. 6) of the base assembly 501 (FIG. 6) of the cover 450. Encasement 701 may be constructed from one piece of heat resistant material that is folded or rolled lengthwise, with its ends sewn together as shown at 710. Alternatively, encasement 701 may be constructed from two pieces of heat resistant fabric that are sewn together along the length of the encasement 701. In this manner, a hollow interior 740 of the encasement is formed. Elastic cord or material 750 is inserted into the hollow interior 740 and preferably runs throughout the length of encasement 701.

The encasement 701 attaches to the perimeter 620 of base assembly 501. The additional material included on this embodiment of encasement 701 is flare 760 attached to encasement 701 via stitching shown at 710 or other attachment technique(s) that are well known in the field. The width 770 of flare 760 may vary but should always be sufficiently wide to provide a grip for the person using the cover 450. The purpose of flare 760 is to protect the user's persons from directly contacting the hot appliance. In FIG. 4, the flare 760 is sufficiently large enough having width 770 to enable the user to grip the cover by flare 760 to pull the cover onto the hot sole plate of an iron without having to place her fingers close to the hot sole plate. In another non-limiting embodiment, the flare 760 may be selectively shortened and be provided at specific locations around the encasement 701 based on a user or manufacturer preference.

FIG. 7 shows the encasement 701 that can be sewn or otherwise attached to the base assembly 501 of the cover 450 at its perimeter 620. Alternative methods of attaching the encasement 701 to the base assembly 501 of the cover 450 may also be used as is known in the art. The completed cover 450 may now be placed on the iron 401. The base assembly 501 of the cover covers the sole plate of the iron while the encasement 701 fits securely around the front tip, shell, and heel of the iron. The cover 450 may include the additional flare 760 and hand grip 640. The protective cover 450 is securely in place while the iron is not in use as depicted in FIG. 4. It will not fall off, and can only be removed upon gripping the encasement 701 by its flare 760 with a person's fingers and extending it off the base of the iron 401.

Figure 8:
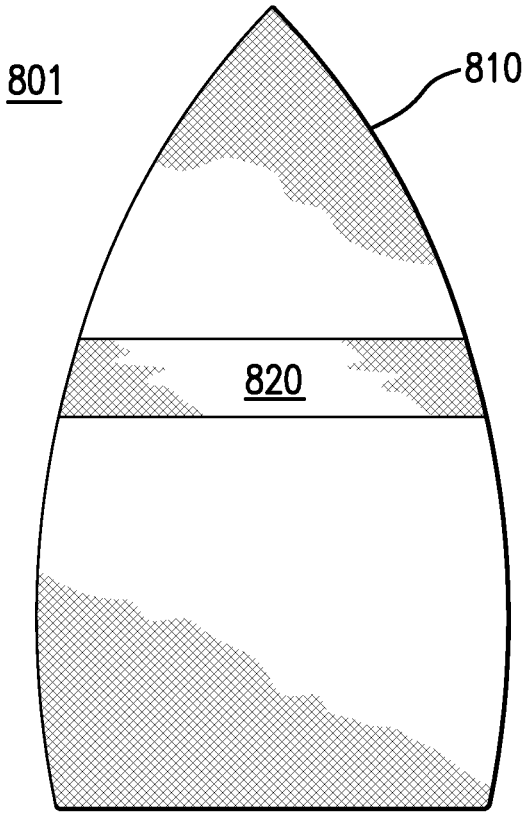
FIG. 8 is a bottom view of an alternative embodiment of the secure protective cover of the invention, shown having a strip of temperature sensitive material.

FIG. 8 is an alternate embodiment of the present invention. More specifically, shown is a bottom view 801 of an alternative embodiment of the secure protective cover of the invention having a strip of temperature sensitive material. The cover 450 in this embodiment is constructed with heat resistant material 810 and includes a strip of temperature-sensitive material 820 added across the bottom. The temperature-sensitive material 820 may be stitched to the bottom or attached in another manner as is well known in the field. This temperature-sensitive material 820 is able to change color based upon the temperature of the material. When the cover is placed over a hot appliance, the color of the temperature-sensitive material will change to a different color to indicate the heat that is emanating through the fabric. When the temperature of the appliance is no longer hot, the temperature-sensitive material 820 will again change color to indicate that the material 820 is not hot.

Figure 9:
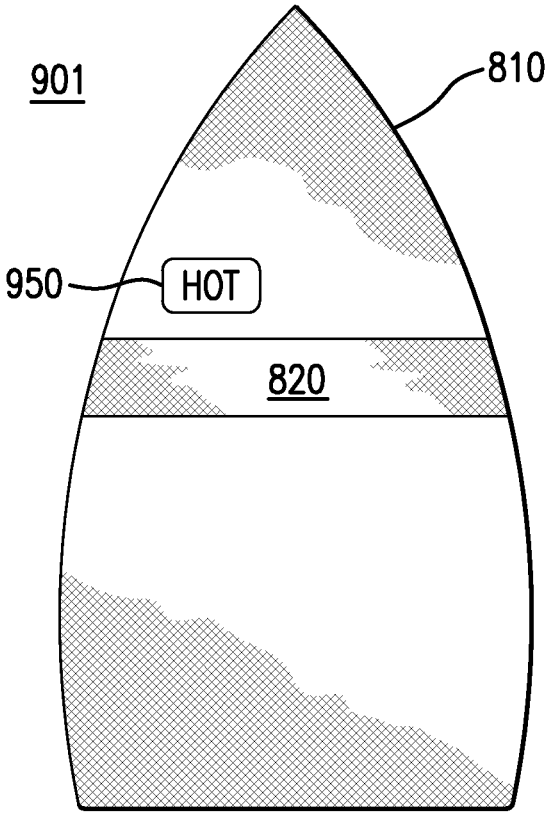
FIG. 9 is a bottom view of an alternative embodiment of the secure protective cover of the invention, shown with a strip of temperature sensitive material that is connected to a visual display.

An alternative embodiment of the present invention can include a visual display 950 as shown in FIG. 9. The visual display 950 can be connected to the temperature sensitive fabric 820. Alternatively, the visual display 950 can have an electronic sensor for detecting temperature or heat. The visual display may be electronic and may display an indication that the iron cover is hot through either a word or words, a display of the temperature of the cover or the underlying sole of the iron or other appliance. The display may have a signal indicator such as a light that displays when the appliance or cover is hot. The light of the display may have a red color when the cover or underlying appliance is hot, and/or a green or other color to indicate when the cover or underlying appliance is not hot.

Figure 10:
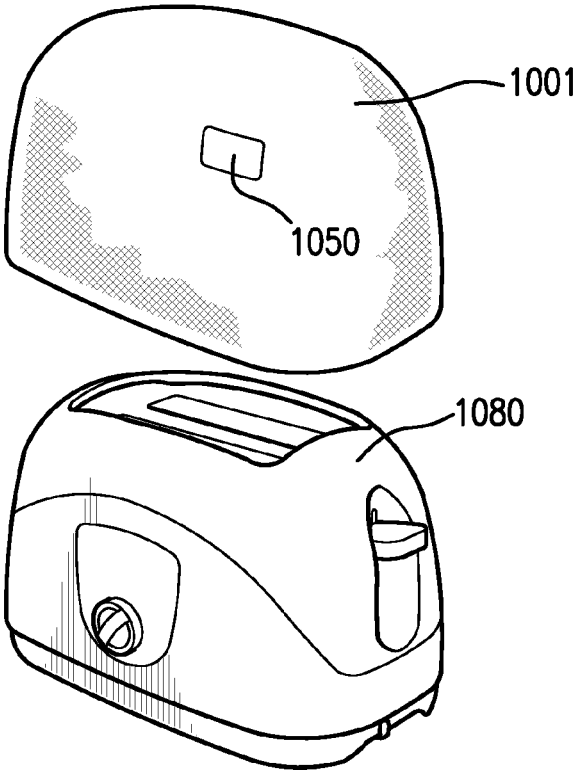
FIG. 10 is an alternate embodiment of the present invention that is a secure protective cover for a toaster appliance.
Figure 11:
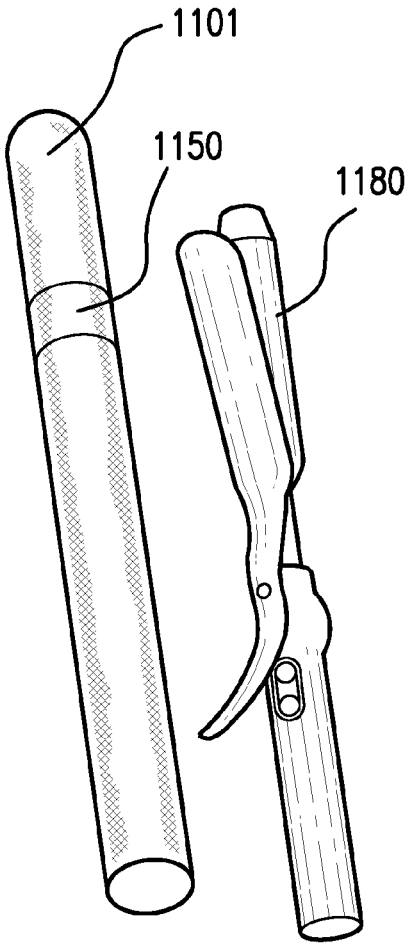
FIG. 11 is another embodiment of the present invention that shows a secure protective cover for a curling iron.
Figure 12:
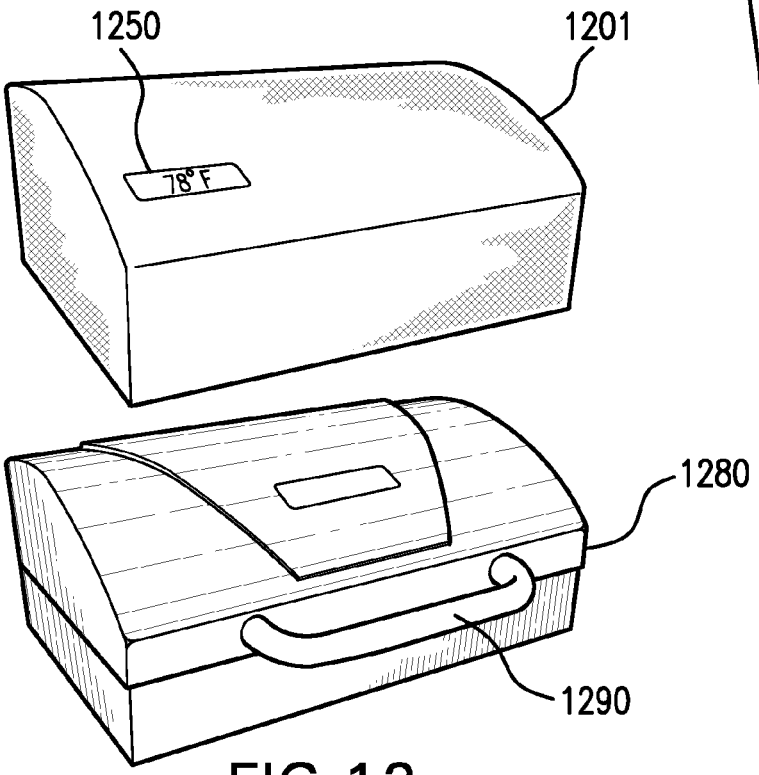
FIG. 12 is another embodiment of the present invention that shows a secure protective cover for a table top grill having a visual display with electronics to detect and display the temperature of the appliance

Additional covers that embody the present invention can be designed for other appliances as shown in FIG. 10. FIG. 10 indicates a cover 1001 with a visual display 1050 for placing on a toaster 1080. FIG. 11 shows a curling iron 1180 with a cover 1101 having a band of temperature sensitive fabric at 1150. FIG. 12 shows a tabletop grill 1280 with handle 1290, and cover 1201 sized to fit over the tabletop grill 1280 and having a visual display 1250 for showing the temperature of the appliance. Covers embodying any of the examples of the present invention may also be created for use with toaster ovens, waffle irons, griddles, hot plates, and the like.

While the present invention has been described with reference to the preferred embodiment and alternative embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

The invention claimed is:

1. A protective cover for an appliance comprising:
a first layer having heat resistant material;
a second layer having insulating material;
a third layer of material;
a fourth layer that forms the exterior of the cover comprising temperature-sensitive, color changing material;
a perimeter encasement made with heat resistant material; and
a band;
wherein said perimeter encasement has an interior space for enclosing the band;
wherein the first, second and third layers are joined together at the perimeters to form the protective cover with the second layer in between the first and third layers, wherein the protective cover is in the shape of a heat emanating surface of the appliance to substantially enclose the heat emanating surface of the appliance within the protective cover, with the first layer laying against the heat emanating surface;
wherein the first, second and third layers are permeable, perforated, comprise openings, or combinations of two or more thereof, for allowing at least some heat to pass through the protective cover to cool down the appliance; and
wherein the perimeter encasement containing the band is attached to the perimeter of the protective cover to secure the cover to the appliance.

2. The protective cover of claim 1, wherein the layers are stitched together at the perimeter of the layers using heat resistant thread.

3. The protective cover of claim 1, further comprising temperature-sensitive, color changing material applied to the third layer of the protective cover.

4. The protective cover of claim 1, wherein the layers are in the form and size of the sole plate of an iron.

5. The protective cover of claim 1 wherein the second layer is comprised of at least one of the following materials: sponge, silicon, rubber, foam, cork, butyl rubber, neoprene, and synthetic insulation.

6. The protective cover of claim 1 wherein the heat resistant material is comprised of at least one of the following: Tencate freestyle, Aramid, Kevlar material, ceramic, stainless steel thread, and glass fiber.

7. A protective cover for an appliance comprising:
a first layer having heat resistant material;
a second layer having insulating material;
a third layer of material;
a temperature-sensitive, color changing material applied to the third layer of the protective cover;
a perimeter encasement made with heat resistant material;
a band for securing the perimeter encasement to the appliance; and
a flare attached to the perimeter encasement and extending outwardly therefrom, the flare comprising a width sufficiently wide to provide a grip in order to secure the protective cover to the appliance;
wherein the first, second and third layers are joined together at the perimeters to form the protective cover with the second layer in between the first and third layers;
wherein said perimeter encasement has an interior space that contains the band and the perimeter encasement containing the band is attached to the perimeter of the protective cover in order to secure the cover to the appliance.

8. The protective cover of claim 7, wherein the flare is comprised of heat resistant fabric.

9. The protective cover of claim 7, wherein the flare extends along the perimeter encasement.

10. The protective cover of claim 7, wherein the flare is present in at least two places on the perimeter encasement.

11. The protective cover of claim 7, wherein the flare comprises a pocket to form a hand grip, wherein the pocket provides for secure handling of the cover when the cover is applied to or removed from a hot appliance.

12. The protective cover of claim 7, further comprising a fourth layer that forms the exterior of the cover comprising temperature-sensitive, color changing material.

13. A protective cover for an appliance comprising:
a first layer having heat resistant material;
a second layer having insulation;
a third layer of material;
a fourth layer that forms the exterior of the cover comprising temperature-sensitive, color changing material;
a perimeter encasement made with heat resistant material;
a band selected from one of an elastic band, a coiled spring, or a drawstring;
a sensor that detects temperature of the protective cover; and
a display that is on the outer third layer of the protective cover;
wherein the first, second and third layers are joined together at the perimeters to form the protective cover with the second layer in between the first and third layers, and wherein the protective cover in the shape of the appliance;
wherein said perimeter encasement has an interior space that contains the band and the perimeter encasement containing the band is attached to the perimeter of the protective cover in order to secure the cover to the appliance; and
wherein the sensor is connected to the display and wherein the display displays a visual indication in response to an output of the sensor reading.

14. The protective cover of claim 13, further comprising temperature-sensitive, color changing material applied to the third layer of the protective cover.

15. The protective cover of claim 13, wherein the display is a digital display of the temperature.

16. The protective cover of claim 13, wherein the display is a light that indicates the temperature of the appliance.

* * * * *